US005188174A

United States Patent [19]

Anderson, Jr. et al.

[11] Patent Number: 5,188,174

[45] Date of Patent: Feb. 23, 1993

[54] APPARATUS FOR INSERTING AND WITHDRAWING COIL TUBING INTO A WELL

[75] Inventor: William L. Anderson, Jr.; Marvin R. Jones, both at Houston, Tex.

[73] Assignee: Stewart & Stevenson Services, Inc., Houston, Tex.

[21] Appl. No.: 679,733

[22] Filed: Apr. 3, 1991

[51] Int. Cl.[5] ..... E21B 19/00

[52] U.S. Cl. ..... 166/77; 166/85; 226/172

[58] Field of Search ..... 166/77, 77.5, 85

[56] References Cited

U.S. PATENT DOCUMENTS

| | | | |
|---|---|---|---|
| 3,052,943 | 9/1962 | Jones | 24/263 |
| 3,116,793 | 1/1964 | McStravick | 166/77 |
| 3,285,485 | 11/1966 | Slator | 166/77 |
| 3,363,880 | 1/1968 | Blagg | 166/77 |
| 3,559,905 | 2/1971 | Palynchuk | 166/77 |
| 3,841,407 | 10/1974 | Bozeman | 166/77 |
| 4,152,015 | 5/1979 | Jones et al. | 285/146 |
| 4,585,061 | 4/1986 | Lyons et al. | 166/77 |

*Primary Examiner*—Ramon S. Britts
*Assistant Examiner*—Frank S. Tsay
*Attorney, Agent, or Firm*—David A. Rose

[57] ABSTRACT

The tubing injection apparatus of the present invention includes a frame upon which is mounted a pair of opposed endless flexible conveyor members. The conveyor members have opposed elongated parallel runs spaced apart to form a path for engagement with the tubing by gripper blocks disposed on the conveyor members. The conveyor members are trained over spaced apart drive sprockets and idler wheels. Rollers are reciprocally disposed on the frame adjacent that side of the opposed elongated parallel runs opposite the path and adapted for engagement with the gripper blocks. The conveyor members include two strands of chain having projecting pins. The gripper blocks are mounted on the projecting pins such that the surface of the projecting pins is coincident with that surface of the gripper blocks which engages the rollers. Hydraulic piston and cylinder assemblies inserted on the frame have rams adapted to engage the rollers so that the rollers may engage the gripper blocks upon actuation of the hydraulic piston and cylinder assemblies. The piston and cylinder assemblies are connected to a common fluid pressure source. The rollers apply a varied force against the gripper blocks such that the gripper blocks grip that portion of the tubing along the path adjacent the well with less force than that portion of the tubing on the path further away from the well.

34 Claims, 8 Drawing Sheets

APPARATUS FOR INSERTING AND WITHDRAWING COIL TUBING INTO A WELL

BACKGROUND OF THE INVENTION

1. Field of the Invention

The present invention pertains to a coil tubing injection apparatus for inserting and removing a continuous length of tubing into a well.

2. Background

Oftentimes in the development and production of a well, an elongated tubing is inserted into the well from the surface for such purposes as the injection of certain types of fluids for stimulation of the production, displacing fluids in the well, and for performing cleaning operations on the production tubing. A continuous length of relatively thin walled steel tubing is inserted into the well from a large reel at the surface. The force required to inject or insert and to withdraw thousands of feet of such tubing are substantial.

U S. Pat. No. 4,585,061 illustrates a typical type of equipment used for tubing injection. A pair of opposed endless flexible conveyor members or chains are arranged to have elongated runs substantially parallel to each other and between which the tubing is straightened and propelled generally downward through a wellhead into the well proper. It is necessary to provide a substantial gripping force on the tubing to perform the injection and withdrawal operations. The tubing injection and withdrawal apparatus includes a frame which supports the opposed endless conveyor chains in such a way that the pull-down and hoisting forces may be applied to the tubing. The opposed endless flexible conveyor members are supported on the frame by spaced apart sprockets and engaged by means adapted to exert equalized gripping forces on the tubing along an elongated contact path between the conveyor members. Each of the endless conveyor members are made up of roller chains and associated support rollers which are engaged by elongated skates or ramp members having a plurality of segments which are, respectively, connected to separate opposed hydraulic cylinder actuators interconnected hydraulically in parallel and arranged mechanically to equalize and balance the clamping or gripping forces exerted on the tubing. The endless conveyor chains are also engaged with tensioning sprockets for maintaining the conveyor chains under a predetermined constant tension to eliminate slack in the chains. Chain tension is maintained by idler sprockets engaging each of the opposed gripping and conveying chains, which sprockets are connected to a pair of opposed linearally extensible hydraulic cylinder actuators which are mechanically and hydraulically connected to provide a uniform equalized tension adjustment force exerted on the endless conveyor chains. The drive mechanism for the gripping and conveying chains includes a pair of hydraulic motor and brake units mounted on a drive casing at the top of the support frame and are directly engaged with drive shafts for supporting and driving the chain driving sprockets. The opposed endless flexible conveyor members are disposed between plates on the frame and are trained over respective double idler sprockets rotatably supported by and between the plates. The conveyor members are each, respectively, drivably engaged with double drive sprockets. The drive sprockets are mounted on drive shafts which are drivenly connected to one of the motors. The conveyor members are each made up of a pair of spaced apart endless roller chains which are interconnected with each other and with a series of tubing gripper blocks by elongated cylindrical pins. The gripper blocks are configured such that the blocks may be nested one within the other. Each block is also provided with a support roller which is rotatably mounted on the pin. The gripper blocks are each provided with an arcuate recess having a radius of curvature only slightly larger than that required for conforming substantially to the radius of the curvature of the tubing. Accordingly, the blocks may be disposed in close fitting gripping relationship to the tubing along a linear path portion disposed between opposed parallel vertical runs of the conveyor members. In operation, the conveyor members forcibly grip the tubing passing along the axis such that the conveyor members grip the tubing so as to be substantially self-centering and load equalizing due to the hydraulic circuitry. The hydraulic cylinders are hydraulically connected in parallel so that the forces exerted by each cylinder on the opposed ramp members are substantially equal. Therefore, uniform loading on the tubing by the conveyor members along the runs may be accomplished.

Prior art tubing injection assemblies are complicated arrangements of support rollers and actuator members for applying a biasing force against the opposed conveyor chain courses or runs which are engaged with the tubing. One of the deficiencies of the prior art is that excessive gaps or cracks are required between adjacent blocks to allow the blocks to pass around the drive and idler sprockets. The prior art gripper blocks have a tang nested within a clevis. As the roller first passes over the tang and then the clevis, alternating forces are applied to the roller. Thus, these gaps or cracks cause an undesirable impact on the conveyor members as the rollers move over the cracks between adjacent blocks. The alternating nature of the gaps and thus the alternating forces causes axial bending in the outer shell of the rollers and eventual failure. It is also preferred to increase the bearing contact area between the rollers of the skates and the back surface of the conveyor members. A greater contact surface allows less pressure per square inch on the conveyor members giving the bearing surfaces of the rollers and bearings a longer life. Further, prior art hydraulic piston and cylinder assemblies are disposed on the ends of shafts which extend between the loops formed by the conveyor members. Such a location of the hydraulic assemblies increases the width of the injector mechanism. Further, the prior art apparatus applies a common gripping force along the length of the tubing so as to increase the stress and fatigue on that portion of the tubing in tension causing the tubing to have a shorter life. Prior art tubing injection devices also require two drive motors each weighing in excess of 640 pounds. These prior art motors are low speed, high torque hydraulic motors using approximately 3,000 pounds of pressure. It is desirable to reduce the weight on the frame caused by these large, heavy motors.

The aforementioned problems associated with the prior art apparatus are resolved by the present invention which provides an improved tubing injection apparatus.

SUMMARY OF THE INVENTION

Those skilled in the art will recognize and further appreciate the above-described features and advantages the present invention as well as other superior aspects thereof upon reading the detailed description which follows in conjunction with the drawings.

Other objects and advantages of the invention will appear from the following description.

BRIEF DESCRIPTION OF THE DRAWINGS

For a detailed description of a preferred embodiment of the invention, reference will now be made to the accompanying drawings.

DESCRIPTION OF THE PREFERRED EMBODIMENT

Figure 1:
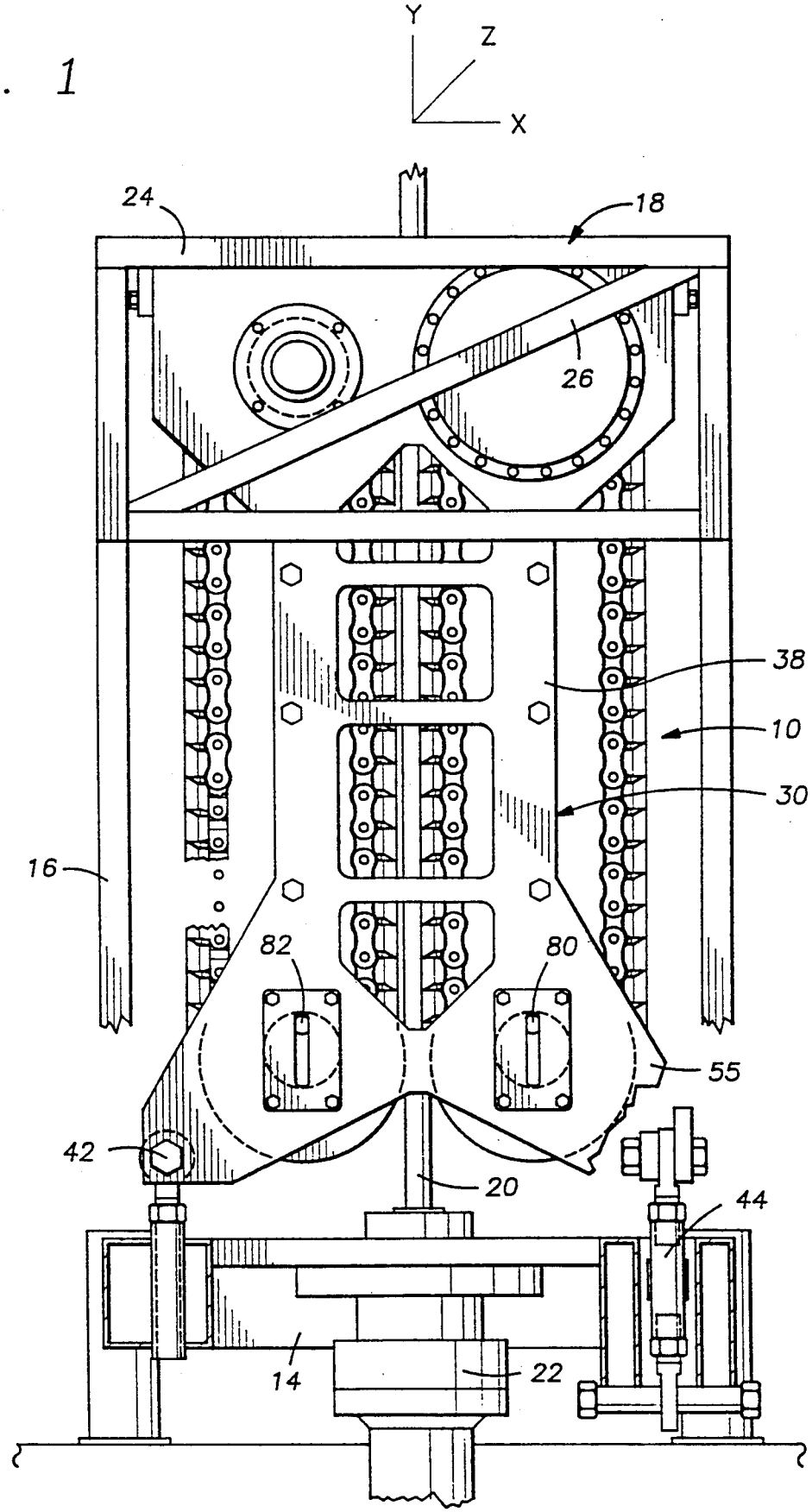
FIG. 1 is an elevation view of the tubing injection apparatus of the present invention.

In the description which follows, like parts are marked throughout the specification and drawings with the same reference numerals, respectively. The drawings are not necessarily to scale and certain features in certain views of the drawings may be shown exaggerated in scale or in schematic form in the interest of clarity and conciseness.

Referring initially to Figure there is illustrated a coiled tubing injection apparatus in accordance with the present invention and generally designated by the numeral 10. For convenience of description, a three dimensional axes is defined in FIG. 1 with the x-axis being horizontal, the y-axis being vertical, and the z-axis being normal to the intersection of the x and y axes. The apparatus 10 is illustrated as being mounted in its working position above the wellhead (not shown) for a well for the extraction of petroleum deposits, as for example. A flanged connection 22 is mounted on a stripper and blowout preventer (not shown) which are mounted on the wellhead. A support frame structure or cage 18 is mounted above the connection 22 to provide support for tubing injection apparatus 10. Cage 18 includes a base 14 with a plurality of spaced apart column members 16 which are adapted to support the tubing injection apparatus 10 so that the apparatus 10 is positioned directly over the connection 22 for the injection and withdrawal of a substantially continuous length of coiled steel tubing, generally designated by the numeral 20. The base 14 has a plurality of legs (not shown) to support the cage 18 above the connection 22. Cage 18 includes a plurality of vertical columns 16, horizontal beams 24 and transverse braces 26 which provide the support for tubing injection apparatus 10. The tubing 20 is inserted and withdrawn from the well through connection 22 and the wellhead. The cage 18 allows the injection apparatus 10 to be lifted to and from a tractor-trailer unit and the wellhead. It also protects the injector apparatus 10.

The coiled tubing injection apparatus 10 is normally associated with support equipment such as a tractor-trailer unit (not shown) having a rotatably mounted reel for supplying the coiled tubing 20. The tractor-trailer unit also includes suitable controls including the requisite hydraulic fluid flow control valves for use in operating the hydraulic system associated with the tubing injection apparatus 10 and described in further detail below. The tractor-trailer unit includes a power source such as an engine driven hydraulic pump and it will be appreciated that, in the operation of the tubing injection apparatus 10, the continuous length of coiled tubing 20 is paid off of or onto the reel and undergoes plastic deformation as it is somewhat straightened from a coiled condition on the reel and then bent in a smooth curve by a tubing guide mechanism (not shown). The guide mechanism may be mounted on the frame 18 and the tubing 20 fed from the guide mechanism to a gripper and conveyor means of tubing injection apparatus 10 whereby it is straightened and forcibly inserted into the wellhead. The tubing 20 is loaded into the tubing injector apparatus 10 such that the plane of the curve of the tubing 20 unwinding from the reel on the trailer truck unit is in the plane formed by the x and y axes and is parallel to the opposing side or gripping forces being applied by the tubing injection apparatus 10 along the x-axis. A typical tractor-trailer unit and tubing guide mechanism is described in U.S. Pat. No. 4,585,061, incorporated herein by reference.

Below the tubing injection apparatus 10, the tubing 20 passes through the wellhead. The tubing injection apparatus 10 pushes or pulls the tubing 20 through the wellhead. The wellhead creates a guide point for the tubing 20 passing from the tubing injection apparatus 10 into and out of the well.

Many studies have been made on the stresses occurring along the gripped length of the tubing 20 as it is inserted into or withdrawn from the well. The loads on the tubing 20 produced by inserting it into the well against well pressure produces a small fraction of the stress level on the tubing 20 to that imposed upon the withdrawal and pulling of the tubing 20 from the well. The withdrawal of the tubing 20 imposes the highest stresses on the tubing 20. Upon the insertion of the tubing 20 into the well, such forces are applied against the shut-in well pressure. The pulling velocity of the tubing 20 from the well may be in the order of 220 feet per minute.

Figure 2:
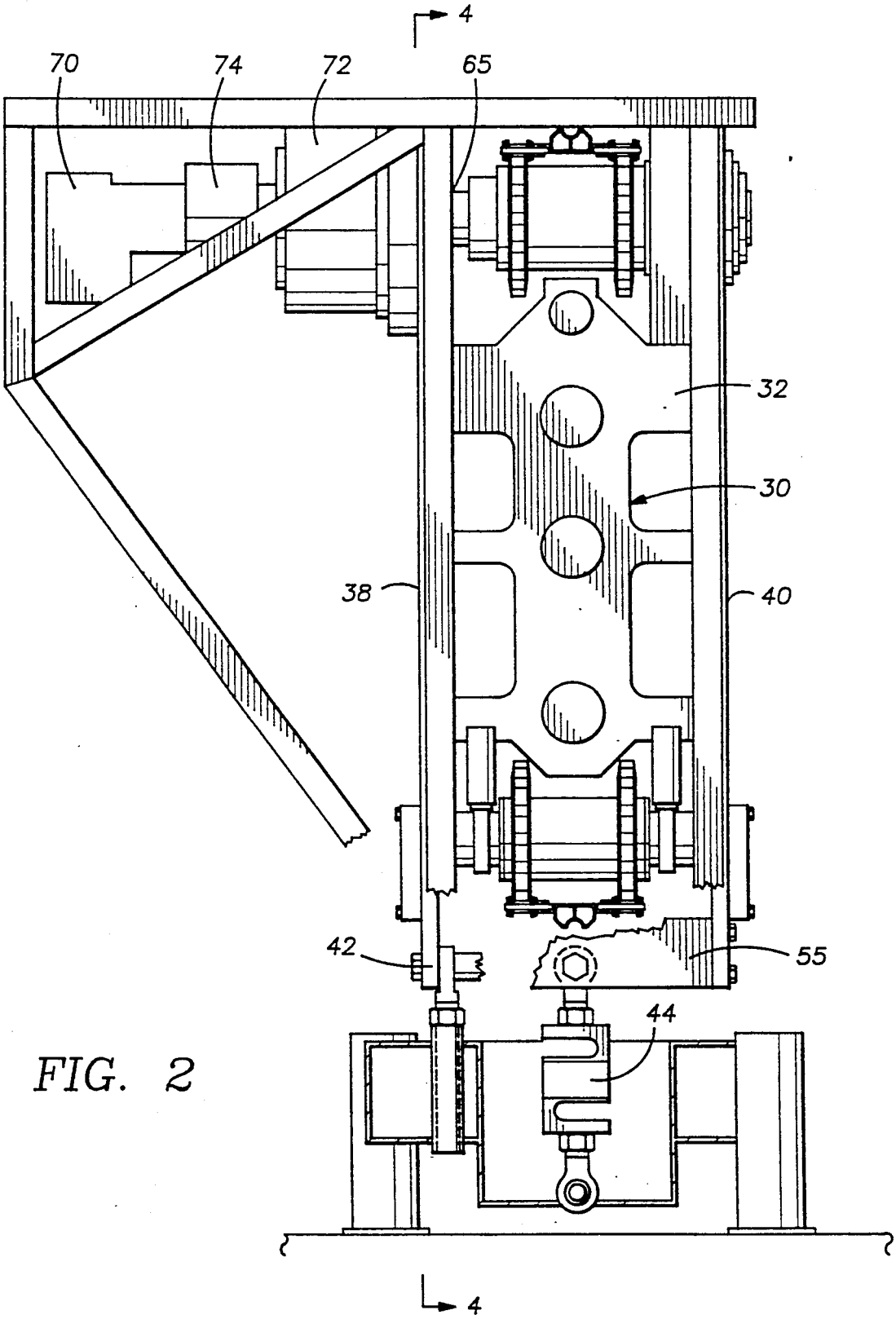
FIG. 2 is a side elevation view of the tubing injection apparatus shown in FIG. 1.
Figure 3:
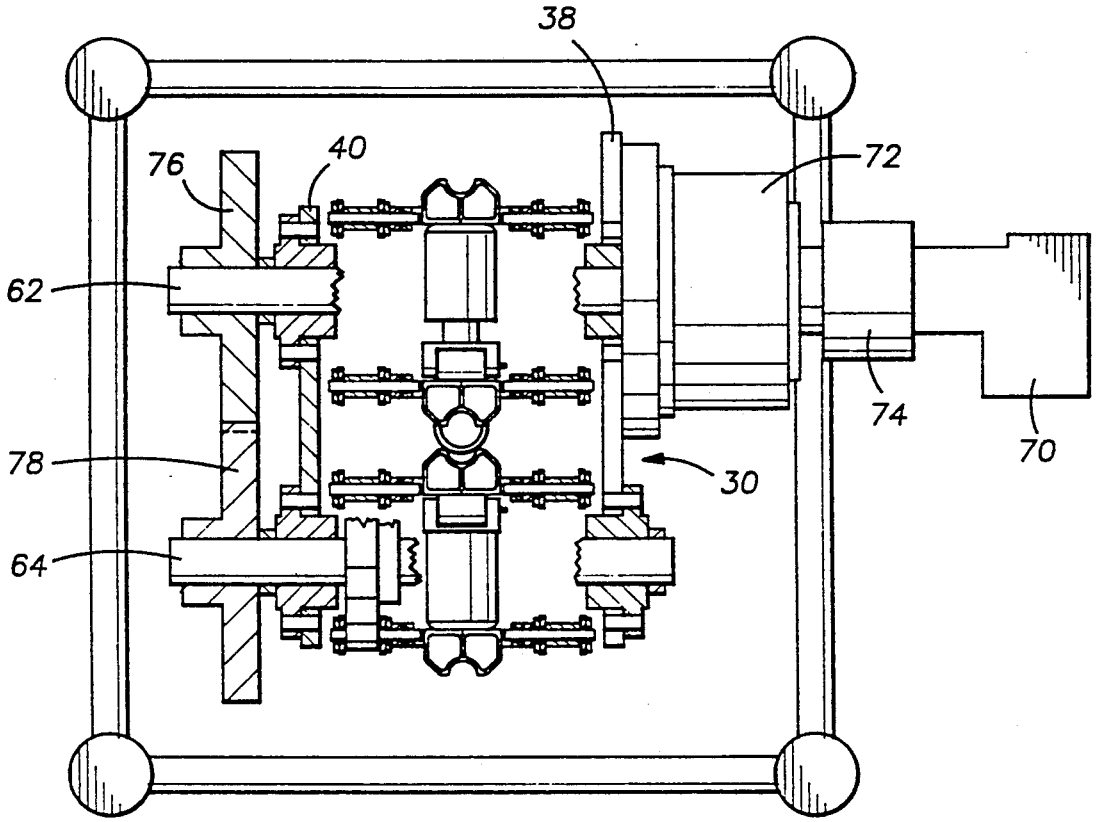
FIG. 3 is a top view of the tubing injection apparatus shown in FIG. 1.

Referring now to FIGS. 2, and 3, tubing injection apparatus 10 includes a support frame, generally designated 30. The frame 30 forms a box and includes two parallel plates 38, 40 connected by bolts to two side spines 32, 34. The spines 32, 34 are approximately two inches thick and include tapped bores for receiving the bolts. The pair of spaced apart vertically extending metal plate members 38, 40 of frame 30 interconnected by the opposed spines 32,34 maintain the plates 38, 40 suitably spaced apart and rigidly secured to each other. Two corners 42 of frame 30 are rotatably pinned to the base 14 of cage 18. A load sensing element 44 such as a load cell is mounted on the opposite side 55 of corners 42 and extends to the base 14. The corners 42 and load sensing element 44 provide a three point connection to base 14. The load sensing element 44 measures the weight of tubing 20 as well as the push or pull force being applied by the tubing injection apparatus 10 to the tubing 20. The corners 42 are mounted on hinges which are attached to base 14. The opposite side 55 is held spaced apart from the base 14 by the load sensing element 44 adapted to at least partially support the frame 30 with respect to the wellhead so as to transmit a signal proportional to the forces exerted between the frame 30 and the wellhead.

Figure 4:
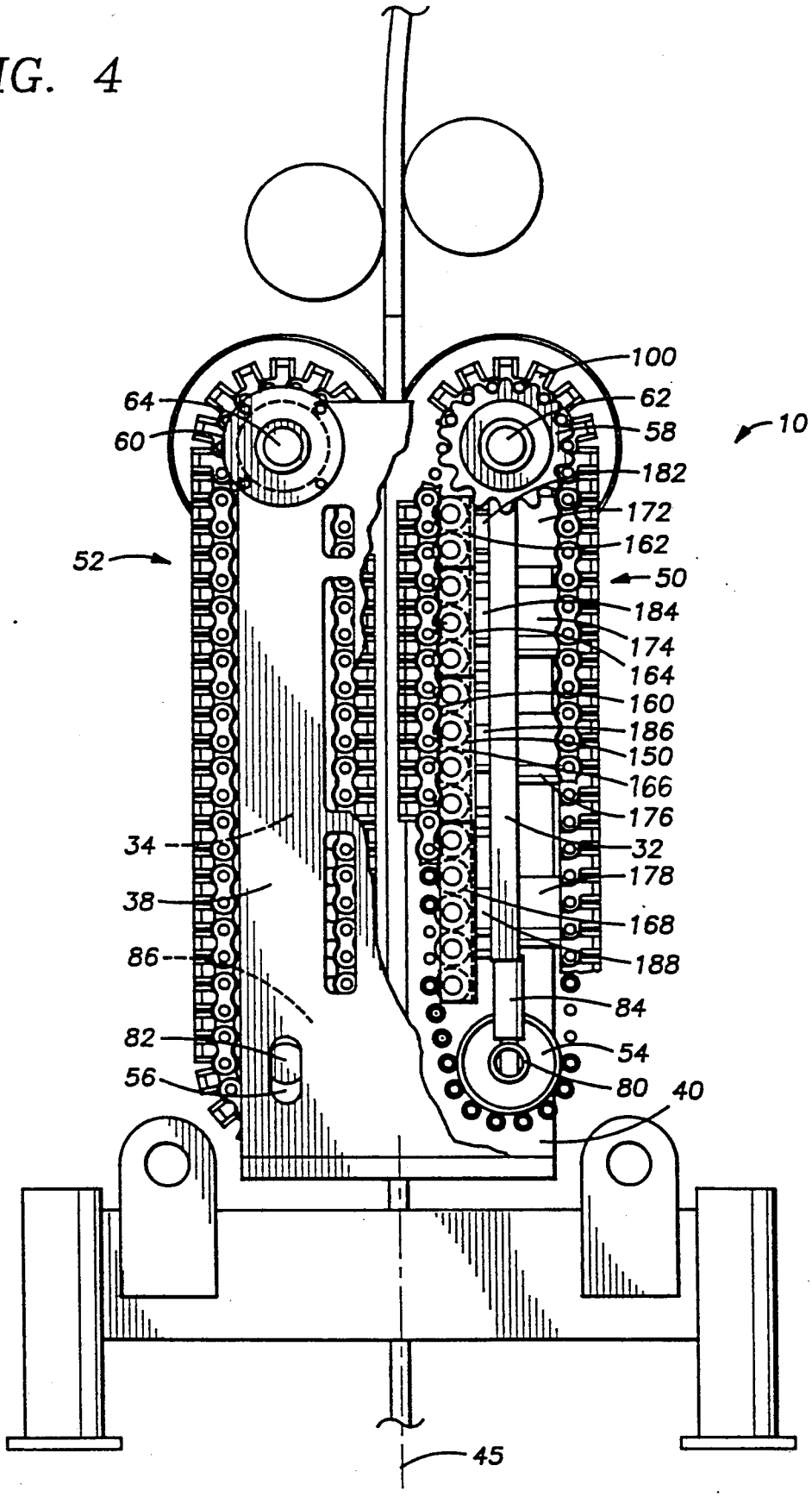
FIG. 4 is a elevation view of the tubing injection apparatus at plane 4—4 shown in FIG. 2.

Referring now to FIG. 4, the gripper and conveyor means of tubing injection apparatus 10 includes a pair of opposed endless flexible conveyor members, generally designated 50, 52, which are disposed between the frame plates 38, 40 and mounted about the y-axis or centerline 45 of apparatus 10. The tubing injection apparatus 10 includes four shafts having pairs of sprockets and wheels mounted thereon. Conveyor members 50, 52 are trained over respective double idler wheels 54, 56 rotatably supported by and between the plates 38, 40. The conveyor members 50, 52 are each, respectively, drivably engaged with upper double drive sprockets 58, 60. The drive sprockets 58, 60 are each mounted on respective drive shafts 62, 64 which are journalled in self-aligning type antifriction bearing assemblies supported on and removable from the drive housing 65.

The lower idler wheels 54, 56 have no teeth so as to only permit the synchronization of the conveyor members 50, 52 at the top drive sprockets 58, 60. Pairs of idler wheels 54, 56 and drive sprockets 58, 60 are required for each of the conveyor members 50, 52. Each pair of idler wheels 54, 56 and drive sprockets 58, 60 is mounted on one end of the same shaft such as drive shafts 62, 64 and idler shafts 80, 82.

As shown in FIGS. 1 and 4, idler wheels 54, 56 and shafts 80, 82 are reciprocally mounted in journals on plates 38, 40. Two hydraulic cylinders 84, 86 are mounted on the shafts 80, 82, respectively, to push the shafts 80, 82 and wheels 54, 56 downwardly so as to apply a constant tension on the conveyor members 50, 52.

Referring again to FIGS. 2 and 3, power is supplied to conveyor members 50, 52 by a hydraulic motor 70 which is connected to a planetary gearbox 72 through a brake 74. The planetary gearbox 72 permits the hydraulic motor 70 to drive both pairs through gears 76, 78 of the top drive sprockets 58, 60. As shown in FIG. 3, the drive shafts 62, 64 are each connected by intermeshed, synchronization gears 76, 78. Drive shaft 62 is connected to the motor output via planetary gearbox 72 and brake 74.

The present invention preferably utilizes a single motor 70 rather than two motors as required by the prior art. Prior art tubing injection apparatus typically uses two 195 cubic inch motors each weighing 640 pounds. Such prior art motors are low speed, high torque hydraulic motors using approximately 3,000 pounds of pressure. Hydraulic motor 70 is a high speed hydraulic motor operating at a range of 4,000 to 7,000 rpms and using up to 6,000 pounds of pressure. The planetary reduction gearbox 72 reduces the speed of the motor 72 for the injection apparatus 10. The high speed hydraulic motor 70 planetary reduction gearbox 72 and brake 74 all weigh approximately one-half that of the prior art low speed hydraulic motors. The high speed hydraulic motor 70 of the present invention weighs only about 70 pounds. Although a single motor 70 is preferred, it should be appreciated that the present invention can be adapted to use the two motors of the prior art.

The present invention is typically offered in two sized units, a 40,000 pound unit capable of pulling 2 ½ inch tubing and a 80,000 pound unit capable of pulling 2 ⅜ inch tubing.

Figure 5:
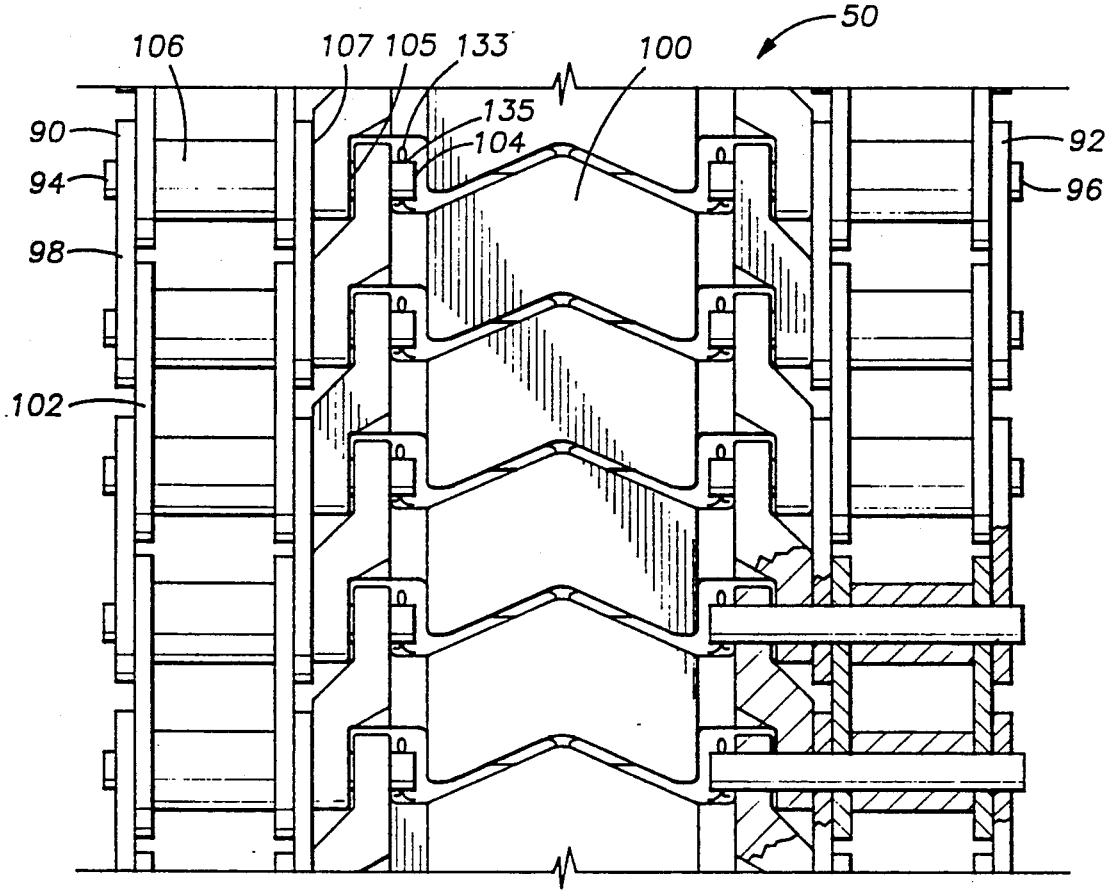
FIG. 5 is a plan view of the endless flexible conveyor member of the present invention.
Figure 6:
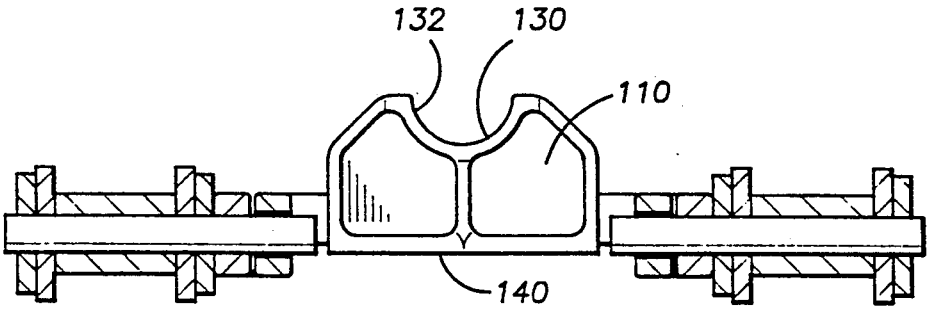
FIG. 6 is an end view of the endless flexible conveyor member shown in FIG. 5.

Referring now to FIGS. 5 and 6, each of the conveyor members 50, 52 are the same and therefore only a description of conveyor member 50 will be given conveyor member 50 is made up of a pair of spaced apart, endless roller chains 90, 92. The two strands of conveyor chain 90, 92 are interconnected with each other through a series of tubing gripper blocks 100 by elongated pins 94, 96 extending respectively from chains 90, 92. The chains 90, 92 are substantially of the conventional industrial roller chain design and are adapted to be interconnected, as indicated, with the gripper blocks 100. The chains 90, 92 can also be removed individually. The drive sprockets 58, 60 shown in FIG. 4 are thus of the type having double sets of sprocket teeth for engaging the respective chain assemblies. The drive sprockets 58, 60 have 14 teeth and the roller chains 90, 92 have a two inch pitch.

Since chains 90, 92 are the same, only chain 90 will be described. Chain 90 includes a series of connecting links 98 having two pins 94 fitted through a series of inner links 102. The inner end 104 of pin 94 extends beyond the inner links 102 and is cantilevered inwardly for attaching the gripping block 100. Rollers 106 are provided between the pairs of connecting links 102. The gripper blocks 100 do not have to be removed from one of the strands of conveyor chains 90, 92 to allow the removal of the other strand of conveyor chain since there is no through pin extending through both strands of chain as in the prior art.

Figure 7:
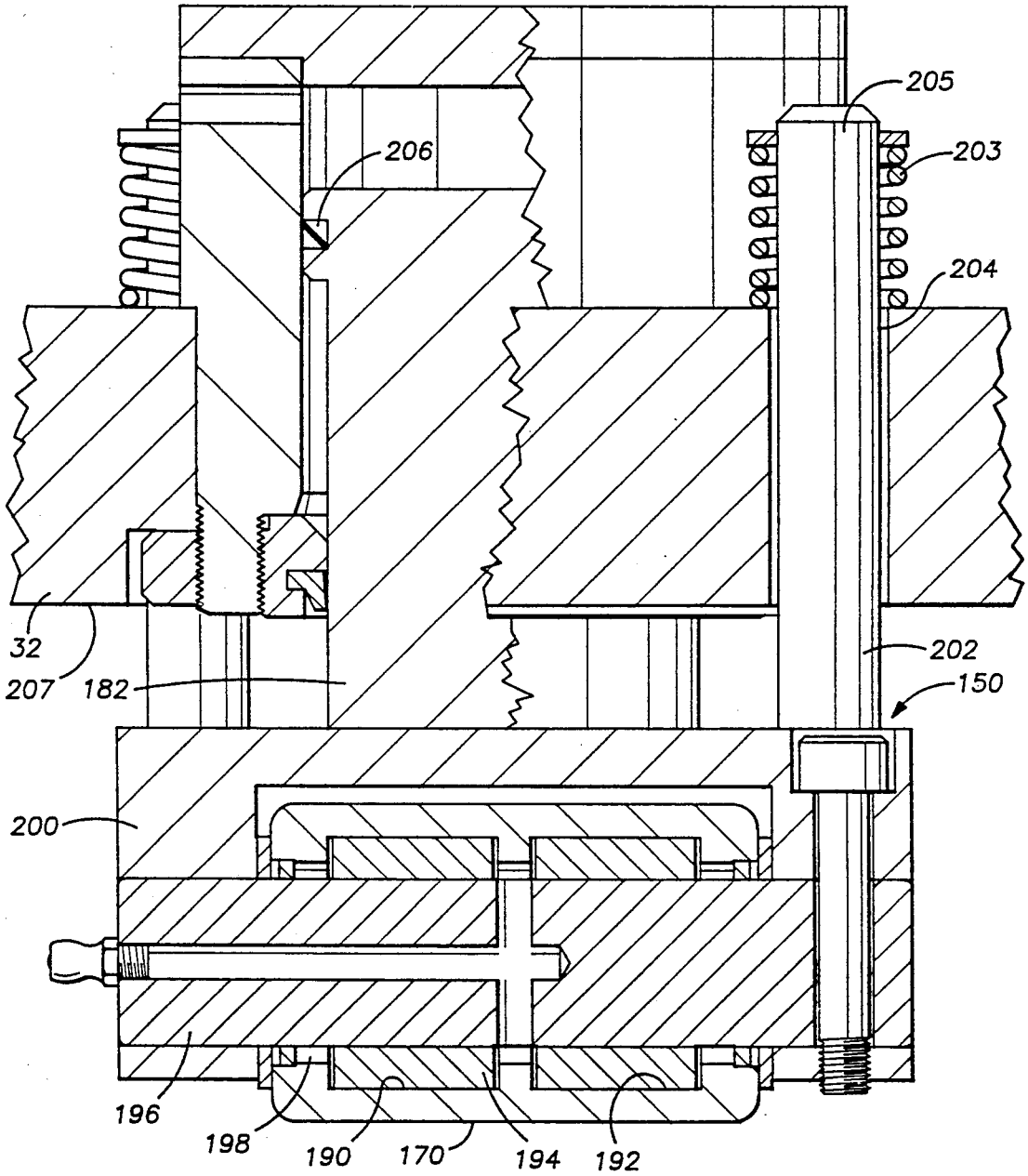
FIG. 7 is a cross sectional view of a skate shown in FIG. 4.
Figure 8:
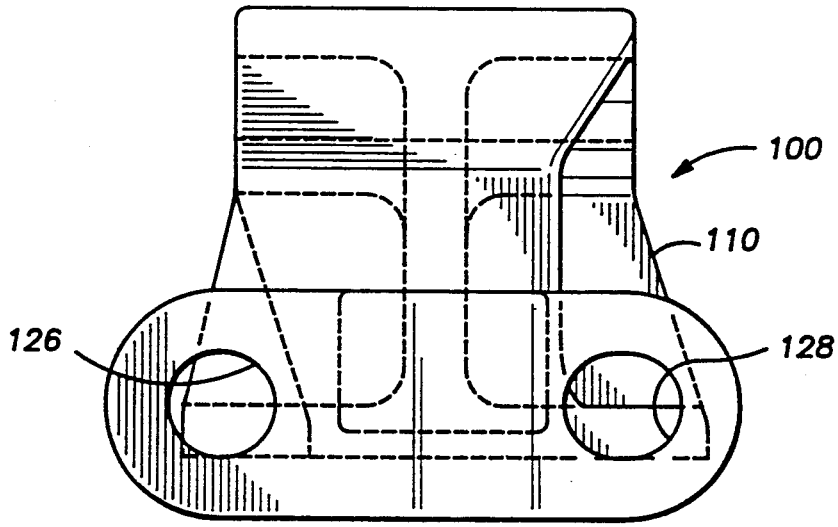
FIG. 8 is a side view of the gripping block of the present invention.
Figure 9:
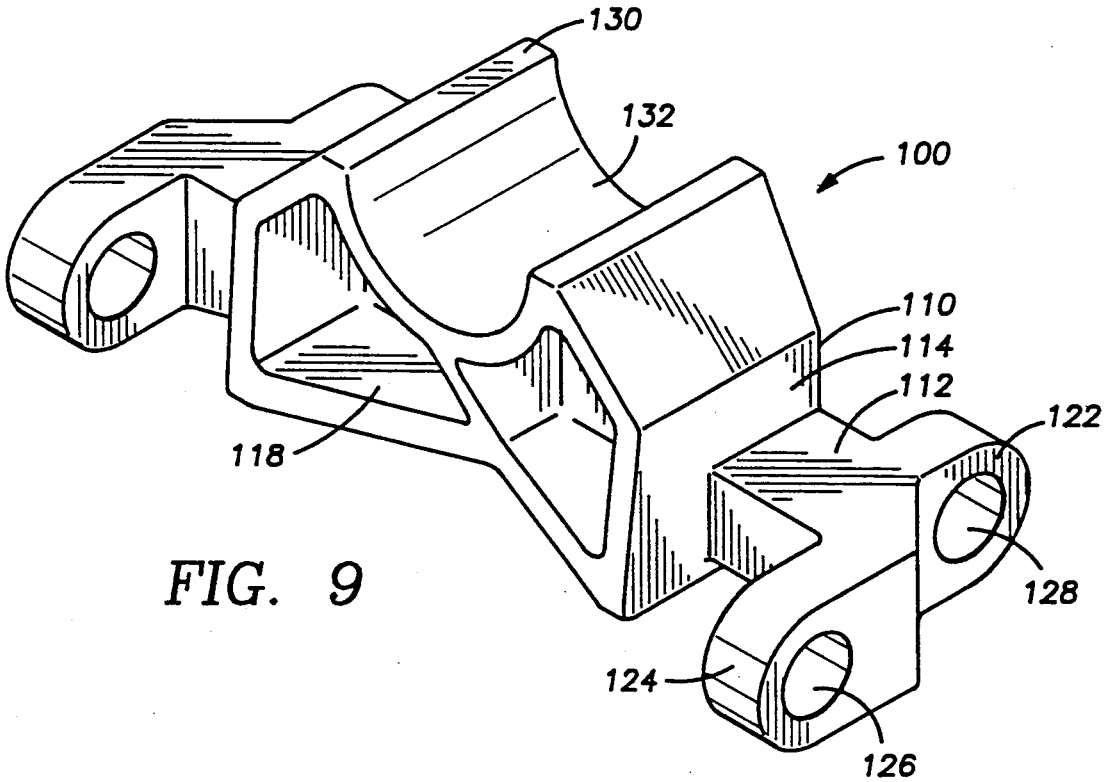
FIG. 9 is a perspective view of the gripping block of the present invention.
Figure 10:
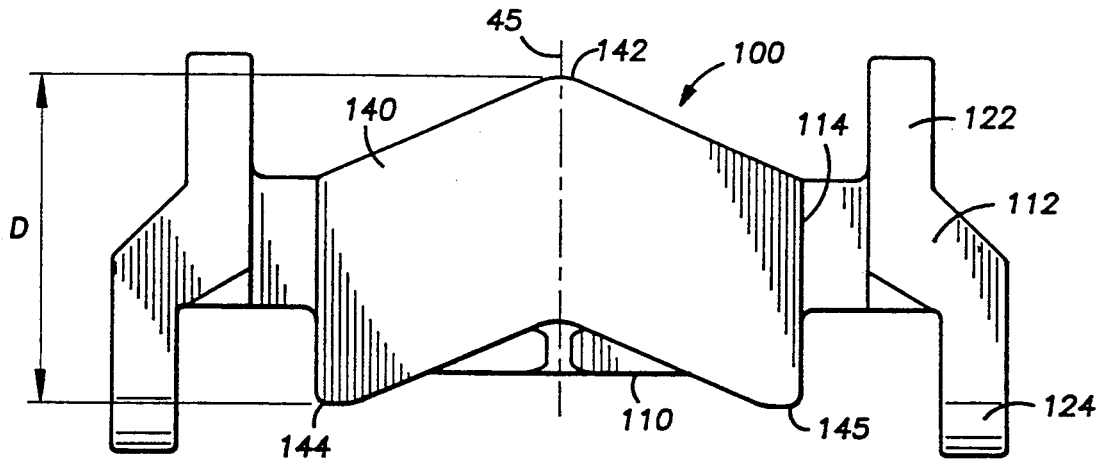
FIG. 10 is a rear view of the gripping block and elevation.
Figure 11:
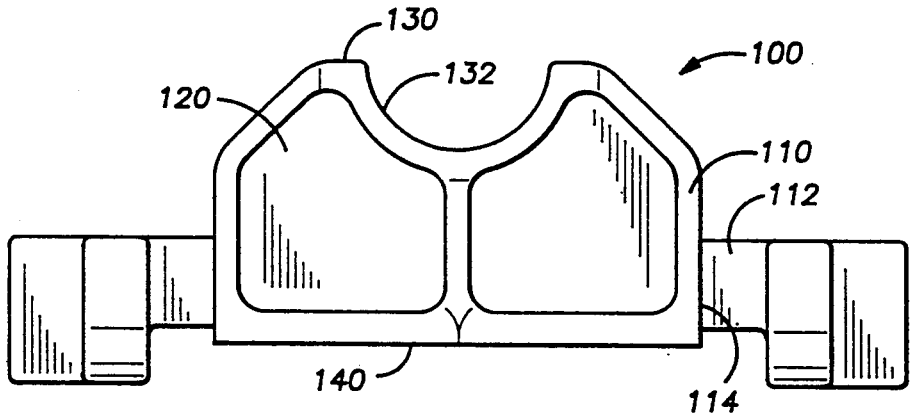
FIG. 11 is a bottom view of the gripping block of the present invention.
Figure 12:
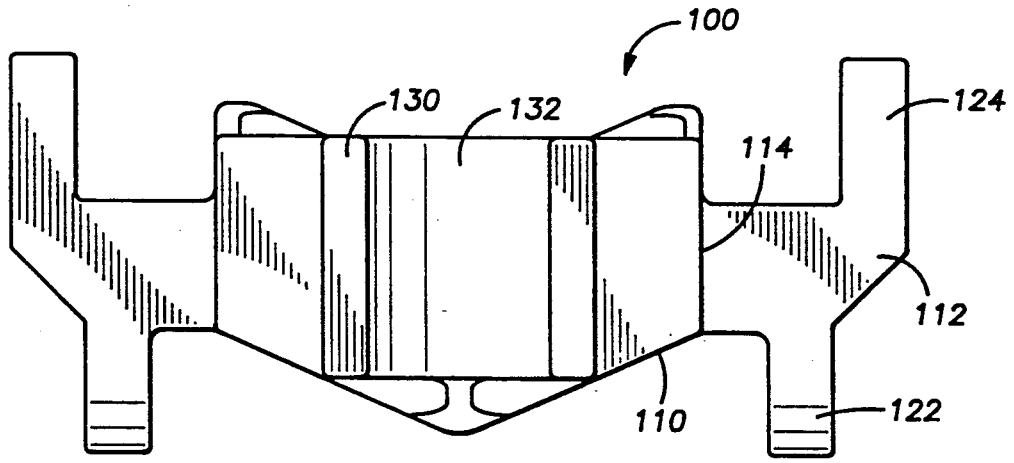
FIG. 12 is a front view of the gripping block of the present invention.

As sown in FIG. 6, the gripper block 100 includes a central body portion 110 having a front surface 130 which grips the tubing 20 and a back surface 140 which engages the rollers 170 of skates 150 shown in FIG. 7. The front surface 130 of the gripping block 100 includes an arcuate recess 132 which substantially conforms to the radius of curvature of tubing 20. The opposed blocks 100 on conveyor members 50, 52 shown in FIG. 4 are disposed in a close-fitting gripping relationship to tubing 20 along a linear path portion generally along centerline 45 and disposed between the parallel straight vertical runs of the endless flexible conveyor members 50, 52. The steel gripping blocks 100 have a 32 inch pressure length with contact pressure heavier at the top.

As shown in FIGS. 4 and 5, the rear surfaces 140 of the gripping blocks 100 form a continuous bearing surface 160. This continuous bearing surface 160 is engaged by the rollers 170 of the skates 162, 164, 166, 168. The rollers 170 apply a force on blocks 100 so as to grip the tubing 20 between the opposed endless flexible conveyor members 50, 52.

The opposed endless flexible conveyor members 50, 52 have a straight linear portion engaging the tubing 20 which is vertical and straight on its back side, namely the continuous bearing surface 160, that can be pushed inward against the tubing 20 by the rollers 170 of the skates 162, 164, 166, 168 upon the actuation of the hydraulic piston and cylinder assemblies which press against the skates. The hydraulic piston and cylinder assemblies 172, 174, 176, 178 are located within the loops 179 formed by the chains 90, 92. In the prior art, the hydraulic assemblies were disposed on the ends of shafts which extended through the loops formed by the chains so as to apply hydraulic pressure on the rollers as the hydraulic assemblies apply pressure on the ends of the shafts. By housing the hydraulic piston and cylinder assemblies of the present invention between the inner and linear portions of the endless puller chains, simple push type rams may be used, eliminating rod seal leakage in pull type rams found in the prior art. Also, a smaller bore cylinder can be used to provide the push force since the rod diameter does not subtract as in a pull type cylinder.

Referring now to FIG. 4, four skates 162, 164, 166, and 168 each have a plurality of rollers 170 which engage and roll along the continuous bearing surface 160 as conveyor members 50, 52 are moved in either the clockwise or counterclockwise direction. For reasons to be hereinafter described, each skate varies in the number of rollers with skate 162 having two rollers 170, skate 164 having three rollers 170, skate 166 having four rollers 170, and skate 168 having five rollers.

Each of the skates are adapted for engagement with a ram of one of the hydraulic piston and cylinder assemblies 172, 174, 176, 178 respectively. The rams 182, 184, 186, 188 are not connected to the skates 162, 164, 166, 168 but the nose of the rams merely contact and engage the skates so as to push them against the conveyor members 50, 52. Only a push type connection is provided. The hydraulic piston and cylinder assemblies 172, 174, 176, 178 are single acting rather than double acting. Single acting piston and cylinders only require one seal for the ram. The rollers 170 are aligned with and push against the continuous bearing surface 160 of gripping blocks 100 such that upon hydraulic actuation, hydraulic piston and cylinder assemblies 172, 174, 176, 178 activate rams 182, 184, 186, 188 respectively to apply forces through skates 162, 164, 166, 168 and conveyor members 50, 52 to the front surface 130 of gripping block 110 and against tubing 20.

All of the hydraulic piston and cylinder assemblies are connected hydraulically to a common hydraulic line. This common hydraulic connection allows the hydraulic system to be compliant. In other words, the opposed hydraulic piston and cylinder assemblies may move up to approximately one inch in the transverse direction of the x-axis while gripping the tubing 20. The tubing 20 is gripped with the same pressure even though the tubing 20 may not be traveling along the precise y-axis or centerline 45 of the injection apparatus 10. This transverse movement is limited mechanically by the conveyor members 50, 52 and the limited space within the injection apparatus 10 itself.

Although the tubing 20 is unwound from the reel or coil and is straightened as it is guided into the tubing injector apparatus 10, the tubing 20 is not bent into the reverse direction and therefore the tubing 20 has a spring back as it passes through the tubing injector apparatus 10. The hydraulic compliance of the present invention allows for this spring back.

This invention also allows for mechanical compliance. The drive sprockets 58, 60 and idler wheels 54, 56 permit a sideways movement of shafts 62, 64 and 80, 82 up to one quarter inch to a side. Thus the floating sprockets allow a sideways movement of the axes of the chains 90, 92. This side clearance in the direction of the z-axis does not need to be as great as the clearance in the direction of the x-axis of the hydraulic rams 182, 184, 186, 188 because of the curvature of the tubing 20. Since the tubing 20 curves in the plane of the hydraulic compliance, the x-y plane, a greater movement must be accounted for. Movement in the direction of the z-axis is limited by the tubing guide means above the injection apparatus 10 and by the wellhead below the injection apparatus 10.

Referring now to FIG. 7, each roller 170 has a pair of races 190, 192 housing a double row of roller bearings 194. An axle or pin 196 passes through the central aperture 198 of roller 170 and is made as large as possible to prevent axle 196 from bending under the load of the hydraulic rams 182, 184, 186, 188. The races 190, 192 are integral with the roller 170 so that roller bearings 194 may be as large as possible and thus larger than those of the prior art. Larger roller bearings are made possible because races 190, 192 are integral with the roller 170 and thus the inner diameter of the races 190, 192 may be increased to house a larger roller bearings 194. The use of these larger roller bearings 194 increases the life of the rollers.

Each roller is made of a tool steel, namely 5210 high strength steel. The axle 196 is non-rotatably mounted at one end on a yoke 200. Each yoke includes four rods 202 affixed at each of its four corners. The rods 202 slide in apertures 204 in the spines 32, 34. Seals 206 are provided around each of the rams. On that side of the spine opposite yoke 200 are mounted retraction springs 203 which are fixed to the terminal ends 205 of rods 202 so as to draw the yoke 200 towards the surface 207 of spine 32 and against the hydraulic rams, such as ram 182.

As the rollers 170 pass along the continuous bearing surface 160 of gripping blocks 100, the rods 202 maintain the rollers 170 and the sides of the yoke 200 in alignment with the continuous back surface 160 of blocks 100.

Referring now to FIGS. 8–12, there is illustrated in detail the gripping block 100 of the present invention. The body 110 of gripping block 100 is cored at its top and bottom 118, 120 for manufacturing purposes. The gripping block is cast. During the casting operation, shrinkage occurs and the cores in top and bottom 118, 120 allow such shrinkage. Further, the coring reduces the weight of the gripping block 100 and, thus, its overall cost. An 8620 carburizing steel is the preferred material for the gripping block 100. The gripper blocks 100 are hardened and may have a roughened surface around arcuate recess 132 of tungsten carbide. It is further preferred that the main body 110 of the gripping block 100 have increased ductility with a hard shell to form hard front arcuate recess 132 and back contact surface 140.

The central body portion 110 includes laterally extending hinges 112 extending from each side 114 of body 110. The laterally extending hinges 112 are integral with the central body 110. The hinges 112 have a generally Z-shaped cross section so as to form an inner ear 122 and outer ear 124. Inner ear 122 is closer to body 110 than is outer ear 124. Outer ear 124 includes a circular aperture 126 and inner ear 122 includes a generally oval shaped aperture 128. Oval shaped aperture 128 is in the form of a double or extended circle and has its longitudinal (longer) axis parallel to the axis 45.

Referring again to FIGS. 5 and 6, pins 94, 96 projecting from links 98 and 102 extend through the round aperture 126 of outer ear 124 of one gripper block 100 and then through the oval shaped aperture 128 of an inner ear 122 of an adjacent gripper block 100. A counterpin 133 passes through a small bore 135 in the terminal end 104 of pins 94, 96 to attach the gripping blocks 100 to the chains 90, 92.

The circular aperture 126 of outer ear 124 has a diameter sized to receive the cantilevered end 105 of pins 94, 96 so as to provide a continuous bearing surface around the pins 94, 96. The transverse (shorter) axis of the oval shaped aperture 128 of ear 122 has a dimension only sufficient to receive the diameter of pins 94, 96 and thereby provide a bearing surface on each side of the pins 94, 96. However, the longitudinal (longer) axis of aperture 128 allows the pins 94, 96 to move along the chain axis 45 within aperture 128. This movement provides only a limited vertical load bearing on pins 94, 96 at the inner ears 122. Since the cantilevered pins 94, 96 are strongest at their base and have a greater bending moment near their freer terminal end 104, it is preferred to place the load on the cantilevered portion 105 of pins 94, 96 in a most favorable manner, namely, loading the base 107 of the pin 94, 96 rather than at the terminal end 104.

The outer ears 124 with the circular aperture 126 thereby transmits a majority of the load to the base 107 of the pins 94, 96. It is preferred that the load be taken by the outer ears 124. Only a minor load is applied to the inner ears 122 when the back contact surface 140 of gripping block 100 is not engaged by one of the rollers 170 of the skates. If one of the rollers 170 is not engaging the back contact surface 140, the gripping block 100 will tend to rotate on the cantilevered portion 105 of pins 94, 96 along the z-axis so as to place a lateral load at the longitudinal end of oval apertures 128 of inner ears 122. The transverse (shorter) length along the x-axis continues to bear a lateral load but the longitudinal (longer) length along the y-axis allows only a limited vertical load bearing on inner ears 122. The present invention prevents movement in the x-y plane and allows movement in the y-z plane.

The back surface 140 preferably has a herringbone or chevron shape. The distance "D" between the front point 142 and rear points 144, 145 of the chevron shape is the same length as the spacing between the adjacent axles 196 of any two adjacent rollers 170 of the skates 162, 164, 166, 168. The rollers 170 are on 2 ½ inch centers such that the point-to-point width D of the rear surface 140 of gripping block 100 is also 2 ½ inches. Since the chains 90, 92 have a 2-inch pitch, the chevron-shaped back surface 140 will have a width D at least equal to the distance between the centers of axles 196 on rollers 170 such that two adjacent rollers 170 will always be in engagement with any particular gripping block 100. Thus, as the rollers 170 move from one gripping block 100 to another, there will be a smooth transition. In the prior art where there were gaps or cracks between adjacent blocks, and undesirable impact as the rollers moved over a crack between two adjacent blocks. The chevron-shaped footprint of the rear surface 140 of gripping bock 100 avoids this impact.

The rear surface 140 of the gripping block 100 provides a greater continuous bearing contact surface 160 with the rollers 170 of skates 162, 164, 166, 168 than those provided by the prior art. The rear bearing surface 160 of the prevent invention may be up to five times greater than that of comparable surfaces of the prior art. A greater contact surface allows less pressure per square inch for a particular pressure output of one of the hydraulic rams 182, 184, 186, 188. Thus, the present invention allows five times less bearing pressure for a particular push force applied in the direction of the x-axis by the rams than did the prior art. The greater the pressure per unit area, the greater the tendency to cause excessive wear on the surfaces of the rollers and bearings. If the unit pressure is too great, the bearing surfaces of the rollers and bearings may deteriorate and become ruined. Thus, it is preferred to reduce the surface pressure per unit area wherever possible. The pressure force from the rams 182, 184, 186, 188 remains the same so as to apply a common force on the tubing 20. In other words, a smaller unit pressure on the bearing surface 160 does not diminish the gripping force of front surface 130 of the gripping blocks 100 on the tubing 20.

Adjacent tubing gripper blocks 100 are nested one within the other on the endless roller chains 90, 92 such that one gripper block 100 moves into engagement with the tubing 20 before another adjacent gripping block 100 moves away from engagement of the tubing 20. Upon two opposing gripping blocks 100 engaging the tubing 20, a gap 212 exists between the faces of the two opposing blocks 100 along the linear portions of the chains 90, 92. The clearance or gap 212 between adjacent gripping blocks 100 is determined by the size of the drive sprocket and the location of the axis of pins 94, 96 with respect to the rear surface 140 of blocks 100. The clearances or gap 212 between the rear surfaces 140 of the gripping blocks 100 are closed as the gripping blocks 100 pas around the curvature of the drive sprockets 58, 60 and idler wheels 54, 56. In the present invention, 14-tooth drive sprockets 58, 60 and two-inch pitch chain 90, 92 are used. These dictate that the actual clearance between adjacent gripping blocks 100 be 0.140 inch. It is preferred that this gap be as small as possible to provide the most continuous surface for rollers 170 to bear against.

The gripper blocks 100 are designed in conjunction with the chains 90, 92. The front contact surface 130 of the gripping block 100 is centered between the axes of pins 94, 96. The arcuate recess 132 of the front tubing contact surface 130 is normally the same radius as that of the tubing 20. It is desirable to have as large a contact area with the tubing 20 as is possible.

The axis of the pins 94, 96 is moved as closely as possible to the continuous rear bearing surface 160 formed by the gripping blocks 100. The pins 94, 96 are moved closer to the surface 160 of the blocks 100 than those of the prior art. The outer diameter or top surface of the pins 94, 96 are coincident with the rear continuous bearing surface 160. To move the pin axis further, the hinges 112 on the gripping blocks 100 would have to be overhung. By moving the pin axis as closely as possible to the rear continuous bearing surface 160, the gaps or clearances 212 between the gripping blocks 100 are minimized to provide a continuous bearing surface 160 for the rollers 170 of the skates 162, 164, 166, 168.

As previously described, the Vertical conveyor members 50,52 are hydraulically actuated by the hydraulic piston and cylinder assemblies 172, 174, 176, 178. However, as distinguished from the prior art where the pressure applied against the tubing 20 is the same along the length of the vertical conveyor run, the hydraulic piston and cylinder assemblies 172, 174, 176, 178 of the present invention apply a variable load on the tubing 20. This variable pressure applied by the hydraulic system of the present invention, loads the tubing 20 in such a way as to reduce to a substantially constant, the Von Mises stress distribution, causing an approximate equivalent stress along the grip length of the tubing 20 under high loading conditions and reducing the stress on the tubing significantly as compared to the prior art. Although the present invention uses mechanical means to vary the side forces along the length of the tubing 20, it should be appreciated that these varied side forces may also be accomplished hydraulically.

Although the same hydraulic pressure is applied to each of the four hydraulic piston and cylinder assemblies 172, 174, 176, 178, the mechanical actuation at the top of the conveyor run is greater than at the bottom of the conveyor run. By applying such a varied loading, the mechanical force is increased as the tension on the tubing 20 is relieved. The amount of force applied to the chains 90, 92 by given rams 182, 184, 186, 188 is varied by the number of rollers 170 mounted on the particular skate. By varying the number of rollers 170, the unit pressure on the tubing 20 is varied. The top hydraulic piston and cylinder assembly 172 is somewhat smaller than the hydraulic piston and cylinders 174, 176, 178 and is dictated by the preferred force curve on the tubing 20. For the top hydraulic piston and cylinder assembly 172 to be of the same size, the upper skate 162 would of had to have had two and one half rollers which is not possible. Thus, the size of the upper hydraulic piston and cylinder assembly 172 was reduced to accommodate skate 162 only having two rollers 170. A mechanical force is applied by the gripping blocks 100 to the tubing 20 due to the application of this hydraulic pressure.

The tubing 20 is gripped between the two vertical conveyor members 50, 52 and it therefore, should be appreciated that the tension on the tubing 20 varies from top to bottom. The gripping blocks 100 of the vertical conveyor members 50, 52 apply a shear load to the tubing 20 and not a bending moment. That portion of the tubing 20 extending below the tubing injection apparatus 10 is in pure tension since that lower portion of the tubing 20 supports the weight of the remaining tubing suspended within the well. That upper portion of the tubing 20 extending from the top of the tubing injection apparatus 10, on the other hand, has almost no tension. Thus, the lower portion of the tubing 20 under tension is not capable of handling as large a gripping force from the tubing injection apparatus 10 as that of the upper portion of the tubing 20 which is not under tension. Consequently, maximum side forces can be applied by the gripping blocks 100 to the upper portion of the tubing 10 that is not under tension. The hydraulic piston and cylinder assemblies must not apply side forces which are so great as to cause the metal to go into the plastic range. Therefore, the present invention applies side forces which are varied to balance the stress on the tubing 20 as it passes through the tubing injector apparatus 10. The internal fluid pressures within the tubing 20 must also be taken into account in determining the amount of side force which ca be applied by the tubing injector apparatus 10.

The present invention appropriately sizes the amount of side force to be applied on the tubing 20 so as to extend the life of the tubing. Whenever the tubing 20 is placed near its plastic range, it will tend to fatigue and ultimately fail. The present invention avoids fatigue in the tubing. Although tubing is expendable, it is preferred to extend the life of the tubing as long as possible.

Generally, it is preferred to apply as light a side force as possible and yet prevent the tubing 20 from slipping through the tubing injector apparatus 10. Slippage is prevented by applying friction to the tubing 10 through the gripping blocks 100 as a function of the normal or side force applied to the gripping blocks 100 by mean of the hydraulic piston and cylinder assemblies.

The total required grip length of the tubing 20 is determined by the optimum radial loading and gripper-block-tubing friction co-efficient. In pushing the tubing 20 into the well, 10,000 pounds of force may be all that is required to inject the tubing into the well since the tubing 20 is pushed into the well against a downhole pressure operating in the opposite direction. However, in withdrawing or pulling the tubing 20 out of the well, a force of 40,000 pounds may be required which approaches the plastic limit of the tubing 20.

The tubing 20 is fed vertically along a linear path coinciding with the axis 45 which extends vertically between the conveyor members 50, 52 extending through the tubing injector apparatus 10. The vertical conveyor members 50, 52 provide a continuous vertical gripping surface formed by the front surfaces 130 of blocks 100 for engagement with the tubing 20. The hydraulic cylinder piston and cylinder assemblies 172, 174, 176, 178 apply the gripping force to the plurality of the gripping blocks 100 that engage the tubing 20. The hydraulic piston and cylinder assemblies operate as units having the same fluid power source.

Prior to hydraulic actuation, the conveyor members 50, 52 have straight runs adjacent the tubing 20 as the tubing 20 is initially inserted into the well. There is approximately a one inch clearance between the tubing 20 and the conveyor runs 50, 52 during this stage. The idler wheels 54, 56 are in their lowermost position at this time. Upon the actuation of the hydraulic piston and cylinder assemblies, the extension of the rams against the skates and the skates in turn pushing the conveyor members 50, 52 cause the straight portions of the conveyor members 50, 52 to travel towards tubing 20 approximately one inch. This movement causes the conveyor members 50, 52 to look like a bow since an arc is created at both ends of the straight portions. The idler wheels 54, 56 move upwardly against the tension. This causes the conveyor members 50, 52 to move away or pull off of the tubing 20 as the conveyor members 50, 52 rotate counterclockwise away from the axis 45 of tubing 20 at the lower end of the apparatus 10.

The overall operation of the tubing injection apparatus 10 is readily understandable to those skilled in the art from the foregoing description. However, the following is a description of the tubing injection apparatus 10 of the present invention being used to inject the continuous length of tubing 20 into the well. Upon installation of the tubing injection apparatus 10 on the connection 22, the various control lines are connected to the load force sensing element 44 and the hydraulic piston and cylinder assemblies 172, 174, 176, 178. Initially the hydraulic piston and cylinder assemblies are retracted to allow the tubing 20 to be threaded between opposed endless flexible conveyor members 50, 52. Once the tubing 20 has been threaded completely through the apparatus 10 and inserted into the well, the conveyor members are brought into a contact with the tubing 20 while applying fluid pressure to the hydraulic assemblies. As the conveyor members 50, 52 are tightened, the gripping blocks 100 will engage and grip opposed sides of the tubing 20. With the tubing 20 in position for injection, side gripping forces are applied to the tubing 20 by the pressure application of the hydraulic assemblies and the chain tension is adjusted by pressurization of the hydraulic assemblies. The tubing 20 is then injected into the well by operating motor 70 to cause the conveyor members 50, 52 to traverse the tubing 20 generally vertically downward. The force with which the tubing 20 is injected is monitored by the signal transmitted from the force sensing element or load cell 44 and the tubing 20 continuously is injected until it reaches the desired location for utilization of the tubing in accordance with its intended function.

When it is desired to withdraw the tubing 20 from the well, the direction of rotation of hydraulic motor 70 is reversed and the gripping action of the conveyors 50, 52 and the blocks 100 adjusted to eliminate any slippage between the conveyor members 50, 52 and the tubing 20. The output signal from the force sensing element 44 is further monitored to prevent separation of the tubing 2 due to exceeding the tensile strength of the tubing 20 with the withdrawal pulling effort.

Although a preferred embodiment of the present invention has been described in detail herein, those skilled in the art will recognize that various substitutions and modifications may be made to the specific embodiment disclosed without departing from the scope and spirit of the invention as defined by the appended claims.

What is claimed is:

1. Apparatus for injecting and withdrawing a substantially continuous length of flexible tubing into and from a well, comprising:

a frame;

a pair of opposed endless flexible conveyor members supported on said frame and having opposed elongated parallel runs spaced apart to form a path for engagement of the tubing by gripper means on said conveyor members;

roller means reciprocally disposed on said frame adjacent that side of said opposed elongated parallel runs opposite said path and adapted for engagement with said gripper means;

hydraulic means having a fluid pressure source and having push rams adapted to engage said roller means to move said roller means into engagement with said gripper means upon actuation of fluid pressure;

said roller means including at least two sets of rollers, each set applying a variable load against said gripper means whereby said gripper means grips that portion of the tubing along said path adjacent the well with less force than that portion of the tubing along said path further away from the well.

2. The apparatus of claim 1 wherein each set of said rollers includes a yoke having said rollers rotatably mounted thereon.

3. The apparatus of claim 2 wherein said roller means includes four sets of said rollers with first, second, third, and fourth yokes wherein said first yoke has two rollers, said second yoke has three rollers, said third yoke has four rollers, and said fourth yoke has five rollers, one of said rams engaging each of said yokes with a common force from said hydraulic means, whereby a varied mechanical force is applied to said gripper means as said gripper means moves along said path.

4. The apparatus of claim 3 wherein said hydraulic means includes a first hydraulic piston and cylinder assembly, a second hydraulic piston and cylinder assembly, a third piston and cylinder assembly, and a fourth piston and cylinder assembly, each of said assemblies being connected to a common fluid pressure source and each having a ram engageable with said first, second, third, and fourth yokes respectively.

5. The apparatus of claim 4 wherein said first hydraulic piston and cylinder assembly is smaller than the other assemblies.

6. The apparatus of claim 4 wherein said assemblies cause said rams to travel approximately one inch.

7. The apparatus of claim 4 wherein each said yoke includes an axle upon which is rotatably mounted one of said rollers, said race housing a double row of roller bearings engaging said axle and said one of said rollers.

8. The apparatus of claim 2 wherein each said yoke includes an integral bearing race for housing bearings engageable with said rollers.

9. The apparatus of claim 2 wherein each said yoke includes a plurality of guide rods slidably mounted in apertures in said frame for guiding the reciprocation of said yokes and rollers with respect to said frame.

10. The apparatus of claim 9 wherein each of said rods includes a return spring for returning said yokes to a retracted position with respect to said gripper means during non-actuation of said hydraulic means.

11. The apparatus of claim 1 wherein each of said sets of rollers applies a different force on said gripper means to produce a substantially constant value of the Von Mises stress along the tubing.

12. The apparatus of claim 1 wherein said conveyor members are trained over spaced apart drive sprockets and idler wheels associated with respective ones of said conveyor members and further including a power drive means for driving said drive sprockets and thus said conveyor members.

13. The apparatus of claim 12 wherein said power drive means includes a single motor with a reduction gear box and brake.

14. The apparatus of claim 12 further including tensioning means mounted between said frame and idler wheels for maintaining tension on said conveyor members.

15. The apparatus of claim 1 wherein said conveyor members each form a loop and said hydraulic means is disposed within said loop on said frame.

16. The apparatus of claim 1 further including a cage for surrounding and protecting the apparatus.

17. The apparatus of claim 16 wherein said frame has one side hinged to said cage and further including a load sensing means mounted on an opposite side of said frame for sensing the forces exerted on the frame as tubing is injected or withdrawn from the well.

18. The apparatus of claim 1 wherein said conveyor members are trained over spaced apart drive sprockets and idler wheels associated with respective ones of said conveyor members and said sprockets and wheels are mounted on shafts which allow limited lateral movement of said gripper means as the tubing deviates from the axis of the apparatus.

19. The apparatus of claim 1 wherein said conveyor members are trained over spaced apart drive sprockets and idler wheels associated with respective ones of said conveyor members and only said sprockets have teeth engaging said conveyor members and said wheels have no teeth wherein synchronization of said conveyor members is provided only at said drive sprockets.

20. Apparatus for injecting and withdrawing a substantially continuous length of flexible tubing into and from a well, comprising:

a frame;

a pair of opposed endless flexible conveyor members supported on said frame and having opposed elongated parallel runs spaced apart to form a path for engagement of the tubing by gripper means on said conveyor members;

a plurality of rollers reciprocally disposed on said frame adjacent that side of said opposed elongated parallel runs opposite said path and adapted for engagement with said gripper means;

means for engaging said rollers to move said rollers into engagement with said gripper means;

said gripper means including a plurality of blocks having a first surface adapted for engagement with the tubing and a second surface engaging said rollers;

said second surface of an individual block having a surface length at least as long as the distance between the centerlines of any two adjacent rollers.

21. The apparatus of claim 20 wherein said second surface has a chevron shape forming a projecting point on one end and a Vshaped recess on the other end.

22. The apparatus of claim 20 wherein said blocks have mating projecting and recessive surfaces whereby adjacent blocks have their projecting surface nesting within the adjacent block's recessive surface.

23. The apparatus of claim 20 wherein said blocks include cored portions to reduce the weight of said blocks.

24. The apparatus of claim 20 wherein said first surface includes an arcuate recess having a radius which approximates the radius of the tubing.

25. The apparatus of claim 24 wherein said first surface is hardened.

26. The apparatus of claim 25 wherein said hinges each include inner and outer projecting ears with said apertures being disposed in said ears.

27. The apparatus of claim 26 wherein said aperture in said outer ear is circular and is sized to slidably receive one of said projecting pins of said chain and said aperture in said inner ear is oval in cross-section.

28. The apparatus of claim 27 wherein said oval aperture has its shortest width sized to slidably receive one of said projecting pins and its longest length substantially longer than the diameter of said projecting pins.

29. Apparatus for injecting and withdrawing a substantially continuous length of flexible tubing into and from a well, comprising:

a frame;

a pair of opposed endless flexible conveyor members supported on said frame and having opposed elongated parallel runs spaced apart to form a path for engagement of the tubing by gripper means on said conveyor members;

a plurality of roller members reciprocally disposed on said frame adjacent that side of said opposed elongated parallel runs opposite said path and adapted for engagement with said gripper means;

means for engaging said roller members to move said roller members into engagement with said gripper means;

said gripper means including a plurality of blocks having a first surface adapted for engagement with the tubing and a second surface engaging said roller members; said conveyor members including two strands of chains having projecting pins and each of said blocks including a pair of hinges extending laterally from each side of said blocks, each of said hinges having apertures for receiving said projecting pins so as to connect said blocks to said strands of chain, said pins having an outer circumferential surface wherein said outer circumferential surface has a portion which is coincident with said second surface whereby the pin axis is located as closely as possible to said second surface for minimizing the gaps between adjacent blocks on said conveyor members.

30. An apparatus for injecting and withdrawing a substantially continuous length of tubing into and from a well, comprising:

a pair of opposed endless flexible conveyor members supported on a frame and having opposed elongated parallel runs spaced apart to form a path for engaging the tubing by gripper blocks disposed on said conveyor members;

a plurality of sets of rollers reciprocally disposed on said frame and engaging said gripper blocks.

said gripper blocks having a first surface adapted for engaging the tubing and a second surface engaging said sets of rollers, said second surface of each gripper block having a length at least as long as the distance between centerlines of adjacent rollers;

hydraulic means having individual rams engaging said sets of rollers to apply a force on said second surface of said gripper block; and said sets of rollers applying a variable load against said second surface of said gripper blocks whereby said gripper blocks apply less gripping force to that portion of the tubing adjacent the well as compared to the gripping force applied to that portion of the tubing adjacent the top of said frame.

31. Apparatus for injecting and withdrawing a substantially continuous length of flexible tubing into and from a well, comprising:

a frame;

a pair of opposed endless flexible conveyor members supported on said frame and having opposed elongated parallel runs spaced apart to form a path for engagement of the tubing by gripper means on said conveyor members;

a plurality of roller members reciprocally disposed on said frame adjacent that side of said opposed elongated parallel runs opposite said path and adapted for engagement with said gripper means;

means for engaging said roller members to move said roller members into engagement with said gripper means;

said gripper means including a plurality of blocks having a first surface adapted for engagement with the tubing and a second surface engaging said roller members;

said conveyor members including two strands of chains having projecting pins with a radius and each of said blocks including a pair of hinges extending laterally from each side of said blocks, each of said hinges having apertures for receiving said projecting pins so as to connect said blocks to said strands of chain; and said pins having a centerline wherein the distance from said centerline to said second surface is equal to or less than the pin radius whereby the pin centerline is located as closely as possible to said second surface for minimizing the gaps between adjacent blocks on said conveyor members.

32. Apparatus for injecting and withdrawing a substantially continuous length of flexible tubing into and from a well, comprising:

a frame;

a pair of opposed endless flexible conveyor members supported on said frame and having opposed elongated parallel runs spaced apart to form a path for engagement of the tubing by gripper means on said conveyor members;

a plurality of roller members reciprocally disposed on said frame adjacent that side of said opposed elongated parallel runs opposite said path and adapted for engagement with said gripper means;

means for engaging said roller members to move said roller members into engagement with said gripper means;

said gripper means including a plurality of blocks having a first surface adapted for engagement with the tubing and a second surface engaging said rollers;

each roller member forming a line contact with said second surface;

adjacent blocks being nested one within another to form a gap therebetween such that said line contact always engages said second surfaces of both of said adjacent blocks as said line contact passes over any part of said gap.

33. Apparatus for injecting and withdrawing a substantially continuous length of flexible tubing into and from a well, comprising:

a frame supporting opposed sides;

a pair of opposed endless flexible conveyor members rotatably supported between said sides and having opposed elongated parallel runs spaced apart to form a path for engagement of the tubing by gripper means on said conveyor members;

roller means reciprocally disposed on said frame adjacent that side of said opposed elongated parallel runs opposite said path and adapted for engagement with said gripper means;

hydraulic means having a fluid pressure source and having push rams adapted to engage said roller means to move said roller means into engagement with said gripper means upon actuation of fluid pressure;

said gripper means having an engaged position for grippingly engaging the tubing and an unengaged position where said gripper means does not engage tubing; and means for retracting said gripper means approximately one inch from said engaged position to said unengaged position.

34. Apparatus for injecting and withdrawing a substantially continuous length of flexible tubing into and from a well, comprising:

a frame supporting opposed sides;

first and second opposed endless flexible conveyor members rotatably supported between said sides, said first and second opposed endless flexible conveyor members forming first and second lops of gripper means, said opposed endless flexible conveyor members forming opposed elongated parallel runs spaced apart to form a path for engagement of the tubing by said gripper means on said first and second conveyor members;

first and second roller means reciprocally disposed on said opposed sides within said first and second loops respectively and adjacent that side of said opposed elongated parallel runs opposite said path and adapted for engagement with said gripper means;

first and second hydraulic means disposed within said first and second loops respectively and between said opposed sides;

said first and second hydraulic means each having a fluid pressure source and having push rams adapted to engage said first and second roller means respectively to move said first and second roller means into engagement with said gripper means upon actuation of fluid pressure.

* * * * *